United States Patent [19]

Straubel

[11] 4,416,233

[45] Nov. 22, 1983

[54] CONTROL APPARATUS FOR INTERNAL COMBUSTION ENGINES

[75] Inventor: Max Straubel, Stuttgart, Fed. Rep. of Germany

[73] Assignee: Robert Bosch GmbH, Stuttgart, Fed. Rep. of Germany

[21] Appl. No.: 123,532

[22] Filed: Feb. 22, 1980

[30] Foreign Application Priority Data

Mar. 7, 1979 [DE] Fed. Rep. of Germany ..... 2908792

[51] Int. Cl.[3] ..... F02D 1/06; F02D 1/14

[52] U.S. Cl. ..... 123/383; 123/382; 92/134

[58] Field of Search ..... 123/383, 382, 391, 381, 123/393; 91/165; 92/134

[56] References Cited

U.S. PATENT DOCUMENTS

| | | | |
|---|---|---|---|
| 3,126,879 | 3/1964 | Canfield . | |
| 3,431,031 | 3/1969 | Ike | 92/134 |
| 3,479,927 | 11/1969 | Woodward | 92/134 |
| 3,981,285 | 9/1976 | Schueler | 123/119 C |
| 4,228,774 | 10/1980 | Ritter | 123/562 |

FOREIGN PATENT DOCUMENTS

| | | | |
|---|---|---|---|
| 563244 | 8/1944 | United Kingdom . | |
| 576886 | 4/1946 | United Kingdom . | |
| 783322 | 9/1957 | United Kingdom | 123/382 |
| 993860 | 6/1965 | United Kingdom . | |
| 1320187 | 6/1973 | United Kingdom . | |
| 1334381 | 10/1973 | United Kingdom . | |
| 1446631 | 8/1976 | United Kingdom . | |

*Primary Examiner*—William A. Cuchlinski, Jr.
*Assistant Examiner*—Carl Stuart Miller
*Attorney, Agent, or Firm*—Edwin E. Greigg

[57] ABSTRACT

A control apparatus for internal combustion engines, which generates an adjustment path on the part of an adjustment member which is proportional to the air mass supplied to the engine. The control apparatus contains a counterpart pressure chamber sealed off from the outside and separated in a pressure-tight manner by an adjustment diaphragm from a first pressure chamber exposed to induced air pressure. A pressure source generating a reference absolute pressure which is constant under all operating conditions is connected to the counterpart pressure chamber. Consequently, the apparatus performs the function of a charge pressure stop equipped with a diaphragm box. The air reservoir of an air pressure brake system, a reservoir charged with the exhaust gas counterpressure or charge air pressure, or a vacuum pump can serve as the pressure source, and an absolute pressure controller controls the reference absolute pressure prevailing in the counterpart pressure chamber.

3 Claims, 1 Drawing Figure

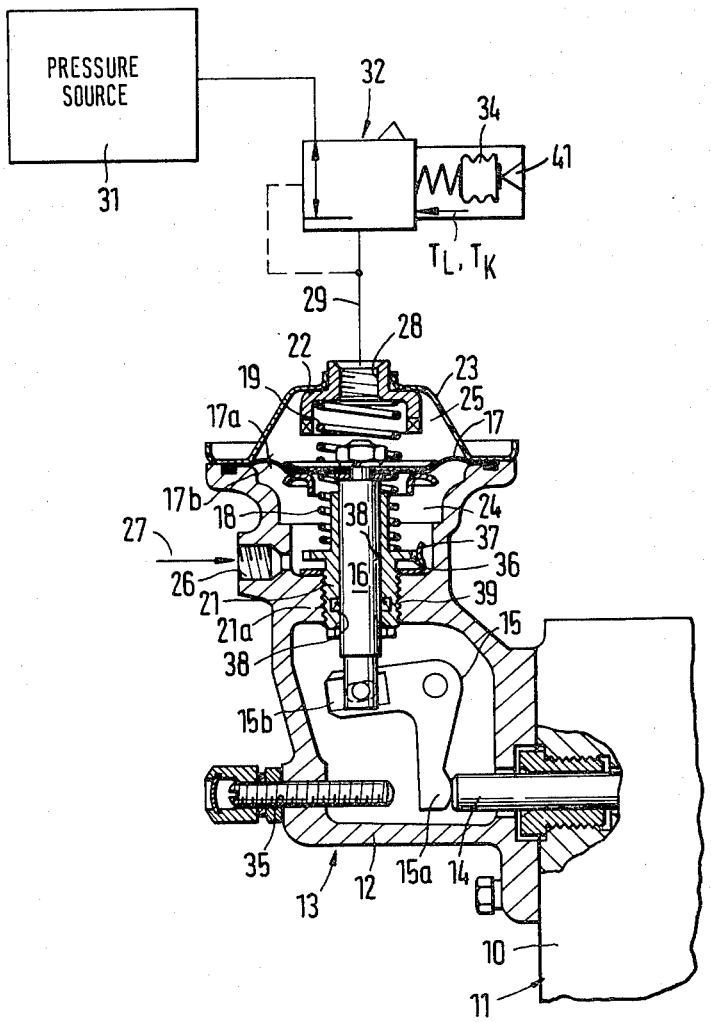
PRESSURE SOURCE
31
32
34
41
$T_L$, $T_K$
29
28
22
19
23
25
17a
17
17b
18
38
24
27
37
36
26
16
39
21
21a
15
38
15b
35
13
12
15a
14
10
11

CONTROL APPARATUS FOR INTERNAL COMBUSTION ENGINES

BACKGROUND OF THE INVENTION

The invention relates generally to a control apparatus for internal combustion engines, and, in particular, to a control apparatus for controlling fuel supplied to an internal combustion engine in accordance with induced air pressure.

Known control apparatus of this type (German Offenlegungsschrift No. 27 31 107) function in accordance with the charge air pressure in the intake manifold of the engine. With an adjustment member which can be subjected to the charge air pressure via a pressure chamber, they either engage the control linkage in order to adapt the controller characteristic curve appropriately to the varying charge air pressure or, as a charge pressure dependent full-load stop, they limit the full-load position permissible at a particular time of the supply quantity adjustment member of the fuel metering apparatus. In these apparatuses, the charge air pressure is utilized as a standard for the quantity of air supplied and it acts on the final control element via an adjustment diaphragm serving as a movable wall and displaceable against the force of a restoring spring. The counterpart pressure chamber located opposite the pressure chamber subjected to the charge air pressure is subjected to atmospheric air pressure and thus this diaphragm-type adjustment member can measure only the difference between the charge air pressure and the atmospheric pressure. This, however, is well known to result in an imprecise air mass signal and thus it falsifies the charge pressure dependent correction of the injection quantity. In order to eliminate this disadvantage, control apparatuses are known (German Auslegeschrift No. 24 48 656) in which an evacuated diaphragm box is used as the restoring means instead of restoring springs, such diaphragm boxes being of the kind also used in correction apparatuses dependent on atmospheric pressure. These diaphragm boxes, if they are additionally supplied with a temperature correction as well, furnish a precise air mass signal; however, in disadvantageous fashion, they have only limited capacity and cannot be highly stressed mechanically; thus they are not suited for use in charge pressure dependent full-load stops which are subjected to severe changes in load and to temperature stresses and which must perform long adjustment strokes rapidly.

OBJECTS AND SUMMARY OF THE INVENTION

The control apparatus in accordance with the invention has the advantage over the prior art in that because of the exposure of the counterpart pressure chamber to the reference absolute pressure, which is constant under all operating conditions, the very sturdy and time-honored design for the charge pressure dependent full-load stop having a movable wall can be retained, and despite this, a precise air mass signal is processed by the adjustment member.

A vacuum pump can be used as the pressure source, which can be done without an additional pressure controller if the pump is of high quality, having a relatively constant absolute pressure (high underpressure), because at an extremely high underpressure thermodynamic fluctuations in barometric pressure have a very insignificant effect. However, an overpressure source already present on the engine can also be used as the pressure source; possible examples of this would be the air pressure of an air-pressure brake system, the exhaust gas counterpressure or the charge air-pressure of a charge air compressor. Pressure fluctuations inherent in the system are compensated for in that the pressure source is provided with a pressure reservoir, and wherever the pressure source does not generate a precise reference absolute pressure, the reference absolute pressure conveyed from the pressure source into the counterpart pressure chamber can be controlled by an absolute-pressure controller to a constant pressure level.

In order to obtain an absolutely precise air mass signal, the reference pressure can be corrected in accordance with the air temperature, preferably the induced-air temperature, the correction taking the form of a pressure increase when the air temperature is increasing. Finally, an additional correction in accordance with the fuel temperature can be superimposed on the correction dependent on air temperature, thus taking into consideration changes in fuel volume dependent on temperature.

The invention will be better understood as well as further objects and advantages thereof become more apparent from the ensuing detailed description of a preferred embodiment, taken in conjunction with the drawing.

BRIEF DESCRIPTION OF THE DRAWING

One exemplary embodiment of the invention is shown in the drawing.

DESCRIPTION OF THE PREFERRED EMBODIMENT

The housing 12 of a control apparatus 13, embodied as a full-load stop dependent on charge pressure, is affixed to a pump housing 10 of a fuel pump 11 serving as a fuel metering apparatus. This stop 13 acts in a known manner directly upon a control rod 14 serving as a supply quantity adjustment member of the fuel injection pump 11. The stop 13 has a bell crank 15 supported in its housing 12, one lever arm **15*a* of which acts as the full-load stop for the control rod 14 and the other lever arm 15*b* of which is coupled with a push rod 16 acting as an adjustment member. In turn, the push rod 16 is connected to an adjustment diaphragm 17 acting as a movable wall. The push rod 16 provided with the adjustment diaphragm 17 is held in the illustrated installed position by the initial tension of two restoring springs 18 and 19. One restoring spring 18 is supported at one end by the adjustment diaphragm 17 and at an opposite end by an adjustment casing 21 threaded into the housing 12. The other restoring spring 19 is supported at one end by the adjustment diaphragm 17 and at an opposite end by a cup-shaped stroke stop 22, which is part of a housing cap 23. The adjustment diaphragm 17 separates, in a pressure-tight manner, a pressure chamber 24 located in the housing 12 from a counterpart pressure chamber 25 enclosed by the housing cap 23. A charge air line 27 indicated in the drawing only by an arrow is connected to the pressure chamber 24 via a connection bore 26. The charge air line 27 connects the pressure chamber 24 with the intake manifold of a supercharged engine and thus the pressure chamber 24 is exposed to the charge air pressure in this intake manifold. The counterpart pressure chamber 25 is connected via a connection bore 28 located in the stroke stop 22 and via a line 29 to a pressure source 31**.

This pressure source 31, in the present case, is an overpressure source already present in the engine, such as the air reservoir of the air-pressure brake system of the associated vehicle, and an absolute pressure controller 32 disposed in the line 29 controls the air pressure supplied to the counterpart pressure chamber 25 to a constant absolute pressure level, as a result of which a reference absolute pressure $p_R$ prevails in the counterpart pressure chamber 25 which is constant under all operating conditions. This reference absolute pressure $p_R$ is exerted upon one pressure side 17*a* of the adjustment diaphragm 17, while the other pressure side 17*b* of the adjustment diaphragm 17 is exposed to the pressure of the charge air supplied via the charge air line 27.

As is indicated schematically in the drawing, the absolute pressure controller 32, which is shown in simplified form as a pressure control valve, contains in known fashion an evacuated diaphragm pressure box 34 which controls a constant absolute pressure at the outlet leading to the counterpart pressure chamber 25, independently of the air pressure fluctuations at the inlet. As is indicated by an arrow, the air temperature $T_L$ and if necessary the fuel temperature $T_K$ as well are also fed into the absolute pressure controller 32 as correction variables. The correction made on the basis of the air temperature $T_L$ takes into consideration the change in air volume, as a result of which the position of the full-load stop 15*a* is fixed exactly by the adjustment member 16 in accordance with the air quantity or air mass supplied. Because the injected fuel also undergoes a change in volume when there is a change in temperature, this change in volume can be taken into consideration in that the reference pressure $p_R$ held at an absolute pressure level is also corrected in accordance with the fuel temperature $T_K$.

The illustrated initial position of the push rod 16 and thus of the full-load stop 15*a* is shown for an engine which is still in the induction phase, for instance during starting, and the reference absolute pressure $p_R$ prevailing in the counterpart pressure chamber 25 is held by the absolute pressure controller to a constant value. When there is an increased charge air pressure supplied, at increasing engine speed, into the pressure chamber 24 via the charge air line 27, the push rod 16 is displaced upward via the adjustment diaphragm 17, against the force of the restoring spring 19 onto the stroke stop 22. The balance of forces between the two restoring springs 18 and 19 and of pressures in the chambers 24 and 25 determines the position of the bell crank 15 and thus also determines the full-load injection quantity. The initial setting of the springs 18 and 19 as well as the supplied reference absolute pressure $p_R$ assure that the injection quantity will be limited in accordance with the air mass which is available to the engine. When the lever arm 15*a* comes to rest against the stop screw 35, the control apparatus 13 is made inoperative, and the fuel injection quantity is then limited in accordance with other factors.

The adjustment casing 21 which is adjustable by means of an insertion thread 21*a* essentially serves to vary the initial tension of the restoring springs 18 and 19, and it is secured in its position by a flexible tongue 37 protruding into detents 36. A guide bore 38 in the adjustment casing 21 which receives the push rod 21 is provided with a sealing ring 39 which seals off the pressure chamber 24 relative to the interior of the housing 12.

The pressure in the counterpart pressure chamber 25, which is controlled to a reference absolute pressure $p_R$, fulfills the function of a diaphragm pressure box and permits the usage of the sturdy and time-honored adjustment diaphragm 17.

If the reference absolute pressure $p_R$ is controlled to a pressure in the vicinity of atmospheric pressure, then it suffices for the system to have a pressure source 31 which needs to have only a low overpressure. In place of the air reservoir of an air-pressure brake system, a reservoir can also be used which is charged by exhaust gas counterpressure or by charge air pressure. A function similar to that of a diaphragm box is also attained if a vacuum pump is used as the pressure source 31; if this pump generates a very high underpressure (that is, a very low absolute pressure), then an absolute pressure controller 32 is not necessary either. If the associated vehicle is equipped with an underpressure brake system, then the associated vacuum pump can serve as the pressure source 31 and the absolute pressure controller 32 must be set accordingly for the control of an absolute underpressure. In the drawing, the correction variables $T_L$ and $T_K$ are plotted as acting parallel to the restoring spring 33. Naturally these correction variables can also correct the position of a support 41 for the restoring spring 33 and the diaphragm pressure box 34 so as to influence the air pressure control.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In a control apparatus for limiting the movement of a supply quantity adjustment member of a fuel metering apparatus for an internal combustion engine in accordance with induced air-pressure in an intake manifold of the engine, which includes a housing, a movable wall disposed within the housing between a first pressure chamber and a counterpart pressure chamber which are defined by the housing and the movable wall, an adjustment member means actuated by the movable wall for limiting the movement of the supply quantity adjustment member, connecting means for connecting the first pressure chamber to the intake manifold of the engine, and restoring means for exerting a force on the movable wall to determine an initial disposition of the movable wall, wherein the movable wall is displaceable by the induced air pressure of the engine against the force of the restoring means, the improvement which comprises:

a pressure source means for generating a reference absolute pressure, including an absolute pressure controller for maintaining the reference absolute pressure at a constant absolute pressure level, and engine parameter correcting means for correcting the reference absolute pressure in accordance with an engine parameter wherein the reference absolute pressure increases when the engine parameter changes; and second connecting means for connecting the pressure source means to the counterpart pressure chamber.

2. A control apparatus in accordance with claim 1, wherein said engine parameter is the induced air temperature of the engine.

3. A control apparatus in accordance with claim 1, wherein said pressure source means further comprises fuel temperature correcting means for additionally correcting the reference absolute pressure in accordance with the fuel temperature wherein the reference absolute pressure decreases when the fuel temperature increases.

* * * * *